US010602795B2

(12) United States Patent
Allen et al.

(10) Patent No.: US 10,602,795 B2
(45) Date of Patent: Mar. 31, 2020

(54) HELMET COMPRISING A SEGMENTED SHELL

(71) Applicant: Bell Sports, Inc., Scotts Valley, CA (US)

(72) Inventors: Scott R. Allen, Scotts Valley, CA (US); Christopher T. Pietrzak, Ben Lomond, CA (US); Allen Bischofberger, Ben Lomond, CA (US); Julio Valencia, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 176 days.

(21) Appl. No.: 15/880,475

(22) Filed: Jan. 25, 2018

(65) Prior Publication Data

US 2018/0206584 A1 Jul. 26, 2018

Related U.S. Application Data

(60) Provisional application No. 62/450,703, filed on Jan. 26, 2017.

(51) Int. Cl.

| | |
|---|---|
| ***A42B 3/00*** | (2006.01) |
| ***A42B 3/28*** | (2006.01) |
| ***A42B 3/12*** | (2006.01) |
| ***A42B 3/06*** | (2006.01) |

(52) U.S. Cl.

CPC ..... *A42B 3/283* (2013.01); *A42B 3/06* (2013.01); *A42B 3/063* (2013.01); *A42B 3/128* (2013.01); *A42B 3/281* (2013.01)

(58) Field of Classification Search

CPC ..... A42B 3/283; A42B 3/06; A42B 3/281; A42B 3/063; A42B 3/128

See application file for complete search history.

(56) References Cited

U.S. PATENT DOCUMENTS 4,434,514 A * 3/1984 Sundahl ..... A42B 3/281 2/171.3
4,622,700 A * 11/1986 Sundahl ..... A42B 3/0493 2/171.3
9,314,063 B2 4/2016 Bologna et al.
(Continued)

FOREIGN PATENT DOCUMENTS

GB 2219728 12/1989
WO 1988006415 9/1988

*Primary Examiner* — Khaled Annis
(74) *Attorney, Agent, or Firm* — Walter M Egbert III; Gerard M. Donovan; Reed Smith LLP

(57) ABSTRACT

A helmet can include a helmet body comprising an energy-absorbing layer and an outer shell disposed over the energy-absorbing layer. An electronic device can be integrated with the helmet body. A first electrical contact can be formed at an exterior of the outer shell and adapted to be in electrical communication with the electronic device. A helmet visor can be coupled to the helmet body with at least one visor arm, the helmet visor comprising controls integrated within the visor. A second electrical contact can be formed at an inner surface of the at least one visor arm and adapted to be in electrical communication with the controls integrated within the visor. The second electrical contact can be adapted to mateably couple with the first electrical contact such that the electronic device and the controls are adapted to be in electrical contact.

20 Claims, 9 Drawing Sheets

(56) References Cited

U.S. PATENT DOCUMENTS

| | | | | |
|---|---|---|---|---|
| 9,545,125 | B2 | 1/2017 | Yoon | |
| 2005/0283885 | A1 | 12/2005 | Stroud et al. | |
| 2006/0156448 | A1 | 7/2006 | Garneau et al. | |
| 2011/0271428 | A1 | 11/2011 | Withnall et al. | |
| 2013/0025031 | A1* | 1/2013 | Laperriere | A42B 3/125 2/414 |
| 2015/0157083 | A1* | 6/2015 | Lowe | A42B 3/128 2/412 |
| 2015/0313307 | A1* | 11/2015 | Wirthenstaetter | A42B 3/32 2/425 |

* cited by examiner

HELMET COMPRISING A SEGMENTED SHELL

RELATED APPLICATIONS

This application claims the benefit of U.S. provisional patent application 62/450,703, filed Jan. 26, 2017 titled "Helmet Comprising a Segmented Shell," the entirety of the disclosure of which is incorporated by this reference.

TECHNICAL FIELD

This disclosure relates to a helmet, such as powersports helmets, comprising a segmented outer shell that provides improved ventilation. The helmet comprising a segmented shell can be employed wherever a conventional powersports helmet is used with additional benefits as described herein.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

SUMMARY

According to a particular aspect of this disclosure, a helmet may comprise a segmented outer shell comprising an upper portion, lower portion, and a reinforcement member disposed between the upper portion and the lower portion to create an elongated segmented opening in the outer shell, an energy management liner disposed within the segmented outer shell and further comprising, an outer energy management layer comprising an opening formed completely through the outer energy management layer, and an inner energy management layer disposed within the outer energy management layer, the inner energy management layer comprising a channel formed completely through the inner energy management layer that is aligned, and overlaps at least 1 centimeter (cm), with the opening in the outer energy management layer and facilitates airflow through the elongated segmented opening.

Particular embodiments may comprise one or more of the following features. The elongated segmented opening may comprise a length greater than 3 cm and a height in a range of 0.2-1.5 cm without a radial line of sight being formed from without the helmet to the energy management liner. The upper portion of the segmented outer shell may cover a top and crown of the helmet. The lower portion of the segmented outer shell may cover side and rear of the helmet, and the elongated segmented opening may extend along an interface of the upper portion of the segmented outer shell and the lower portion of the segmented outer shell from the a-pillar of the faceport toward a rear of the helmet. The reinforcement member may be formed as a bushing coupled to a pin formed of a unitary construction with either the upper portion of the segmented outer shell or the lower portion of the segmented outer shell. The reinforcement member may be formed as a bushing made of a material softer than the outer shell. The elongated segmented opening may comprise a length in a range of 3-20 cm. The outer energy management layer may be formed of expanded polystyrene (EPS) when the inner energy management layer is formed of expanded polypropylene (EPP).

According to another aspect of the disclosure, a helmet may comprise a segmented outer shell comprising an elongated segmented opening, an energy management liner disposed within the segmented outer shell and further comprising, an outer energy management layer comprising openings formed completely through the outer energy management layer, and an inner energy management layer disposed within the outer energy management layer, the inner energy management layer comprising channels formed completely through the inner energy management layer that are aligned, and overlap by at least 1 centimeter (cm), with the openings in the outer energy management layer and facilitate airflow through the elongated segmented opening.

Particular embodiments may comprise one or more of the following features. The elongated segmented opening may comprise a length greater than 3 cm and a height greater than 0.2 cm without a radial line of sight being formed from without the helmet to the energy management liner. The upper portion of the segmented outer shell may cover a top and crown of the helmet. The lower portion of the segmented outer shell may cover side and rear of the helmet. The elongated segmented opening may extend along an interface of the upper portion of the segmented outer shell and the lower portion of the segmented outer shell from the a-pillar of the faceport to a rear of the helmet. The segmented outer shell may further comprise a first portion, a second portion, and a reinforcement member disposed between the first portion and the second portion to create the elongated segmented opening in the outer shell. The reinforcement member may be formed as a bushing made of a material softer than the outer shell. The reinforcement member may be coupled to pins formed of unitary construction with either the first portion of the segmented outer shell or the second portion of the segmented outer shell. The elongated segmented opening may comprise a length in a range of 1-20 cm.

According to another aspect of the disclosure, a helmet may comprise a segmented outer shell comprising an upper portion, lower portion, and a reinforcement member disposed between the upper portion and the lower portion to create an elongated segmented opening in the outer shell, and an energy management liner disposed within the segmented outer shell and further comprising a channel formed completely through the inner energy management layer that is aligned, and overlaps at least 1 centimeter (cm), with the opening in the outer energy management layer and facilitate airflow through the elongated segmented opening.

Particular embodiments may comprise one or more of the following features. The elongated segmented opening may comprise a length greater than 3 cm and a height greater than 0.2 cm without a radial line of sight being formed from without the helmet to the energy management liner. The upper portion of the segmented outer shell may a top and crown of the helmet. The lower portion of the segmented outer shell may cover side and rear of the helmet. The elongated segmented opening may extend along an interface of the upper portion of the segmented outer shell and the lower portion of the segmented outer shell from the a-pillar of the faceport to a rear of the helmet. The energy management liner may further comprise an outer energy management layer comprising an opening formed completely through the outer energy management layer, and an inner energy management layer disposed within the outer energy management layer, the inner energy management layer comprising the channel that overlaps with the opening in the outer energy management layer and the elongated segmented opening. The reinforcement member may be formed as a bushing made of a material softer than the outer shell. The reinforcement member may be formed as a bushing coupled to a pin formed of unitary construction with either the upper portion or the lower portion.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112(f). Moreover, even if the provisions of 35 U.S.C. § 112(f), are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

DETAILED DESCRIPTION

Figure 1:
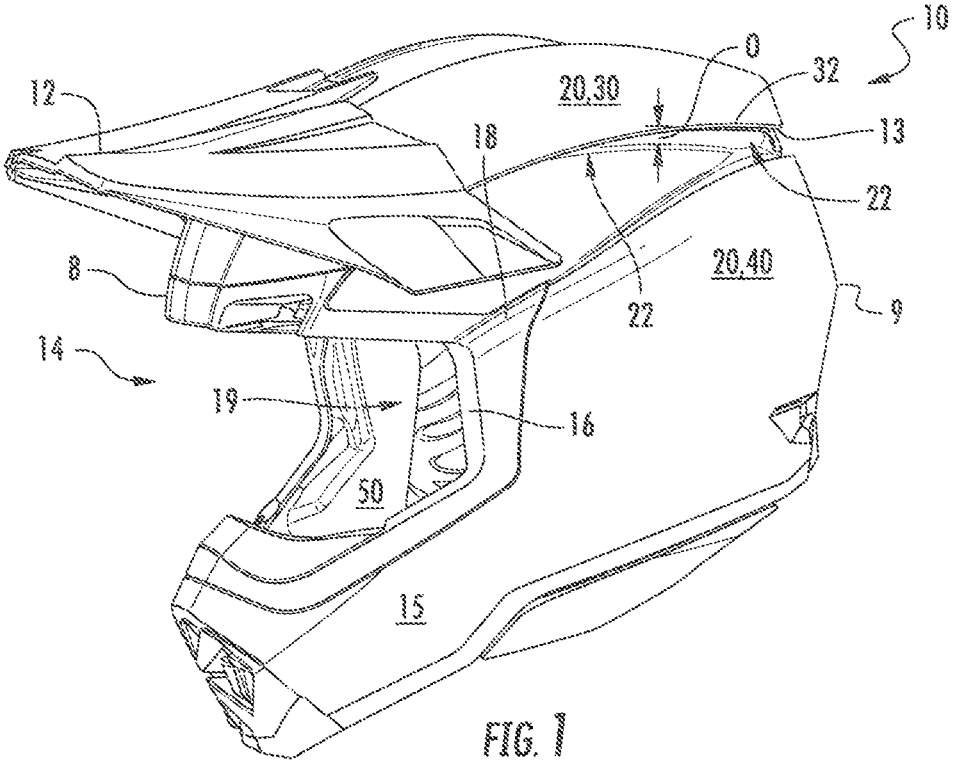
FIG. 1 shows a side view of a helmet comprising a segmented shell.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and an inner energy-absorbing layer, such as foam. The protective helmet can be a bike helmet used for mountain biking, motocross, powersports, snow sports, cycling helmets, water helmets, skateboard helmets, other sports, and in other industries using protective headwear or helmets including visors, for individuals such as construction workers, soldiers, fire fighters, and pilots. Each of the above listed sports, occupations, or activities can use a helmet that includes single or multi-impact rated protective material base that can also include comfort padding or support material on at least a portion of the inside of the helmet. More particularly, the features and improvements of the helmet described herein can benefit off-road helmets, or helmets used for off-road activities, such as motocross helmets. As appreciated by those of ordinary skill in the art, motocross helmets are formed without face shields or translucent or transparent visors to cover the faceport of the helmet and the face of the helmet wearer. However, even with the open faceport and no shield, motocross helmets have conventionally had poor ventilation, making them at times hot and uncomfortable for the helmet wearer.

FIG. 1, depicts an elevational side view of a left side 7 of a powersports helmet 10 according to a non-limiting aspect of the present disclosure. The helmet 10 comprises a segmented outer shell or segmented shell 20, an energy management, energy-absorbing, or impact material, layer, or liner 50 disposed within the outer shell 20. The helmet 10 may also comprise a visor 12 disposed over, and providing shade to, a faceport 14 in the helmet. While the helmet 10 is shown as a full-face helmet, comprising a chin guard 15 that can define a lower edge of the faceport 14, in some instances, the helmet 10 can be formed without the chin guard 15. The chin guard 15 when present, may attach to a main body of the helmet 10 at the A-pillar 16, where the A-pillar defines a rearmost portion of the faceport.

The energy management liner 50 can comprise one or more materials or layers, such as an outer energy management layer 60 and an inner energy management material or layer 80. The outer shell 20 can comprise any materials known in the art of helmets, such as, but not limited to, one or more of ethylene vinyl acetate (EVA) Acrylonitrile butadiene styrene (ABS), polyvinylchloride (PVC), polycarbonate (PC), polyethylene terephthalate (PET), or other plastic, as well as, resin, fiber, fiberglass, carbon fiber, textile, Kevlar, or other suitable material, whether cast, formed, molded, stamped, in-molded, injection molded, vacuum formed, or formed by another suitable process.

The energy management liner 50 can comprise one or more layers of any materials known in the art of helmets, such as, but not limited to, one or more of plastic, polymer, foam, or other suitable energy absorbing material that can flexibly deform with a hard outer shell to absorb energy and to contribute to energy management without breaking. The energy management liner 50 can be one or more layers of expanded polypropylene (EPP) or ethylene vinyl acetate (EVA), which can be used as an energy absorbing and energy attenuating material that is flexible and is able to withstand multiple impacts without being crushed or cracking. In other instances, expanded polypropylene (EPP) foam, expanded polystyrene (EPS), expanded polyurethane (EPTU or EPU), or expanded polyolefin (EPO) can be used or in-molded to absorb energy from an impact by being crushed or cracked.

A comfort liner or fit liner can be disposed inside the outer shell 20 and inside the energy management liner 50 while being disposed adjacent, and in contact with, the energy management liner 50. The comfort liner can be made of textiles, plastic, foam, or other suitable material, such as polyester. The comfort liner can be formed of one or more pads of material that can be joined together, or formed as discrete components, that are coupled to the inside of the energy management material, the outer shell, or both. The comfort liner can be releasably or permanently coupled to the impact liner using snaps, hook and loop fasteners, adhesives, or other suitable materials or attachment devices. As such, the comfort liner can provide a cushion and improved fit for the wearer of hard shell helmet.

As can be seen in FIG. 1, segmented outer shell 20 of helmet 10 may define or provide elongated segmented openings, gaps, vents, or channels 22 between segments or portions of the outer shell 20, such as the upper portion 30 and the lower portion 40. Thus, rather than having a single unitary outer shell comprising a continuous unbroken surface as has been conventionally used, the segmented outer shell can comprise multiple non-planar segments, such as upper portion 30 and lower portion 40, that form elongated segmented openings 22. The elongated segmented openings 22 can be long and continuous while extending between, along, or adjacent, edges of adjacent helmet segments. As shown in FIG. 1, e.g., the elongated segmented opening 22 can extend between, along, and be defined by, an outer or lower edge 32 of the upper portion 30 and an outer or upper edge 42 of the lower portion 40. Various views of the edges 32 and 42 are also shown throughout the FIGs., including in FIGS. 4A-4F.

As such, the elongated segmented openings 22 may extend all the way around, or substantially around (such as 60% or more, 70% or more, 80% or more, or 90% or more) around a circumference or perimeter of the helmet 10 (which may include omitting areas already open such as the faceport 14 when calculating a percentage of perimeter covered by the elongated segmented opening 22). In some instances, a length L of the segmented openings 22 between the forward most portion 11 and the rearward most portion 13 of the segmented openings 22 will be in a range of 1-25 centimeters or 3-25 centimeters (cm) (0.8-10 inches (in.)), 13-25 cm (5-10 in.), or greater than 1 cm, 3 cm, 15 cm, or 20 cm (1.2 in., 6 in. or 8 in.). In some instances, the segmented opening 22 may be formed as a single continuous opening that begins near the faceport 14, in-line or substantially in-line with the A-pillar 16, such as having an end laterally offset a distance in a range of 0-4 cm, 0-3 cm, 0-2 cm, or 0-1 cm from a line extending vertically from an A-pillar 16 or from a center of the A-pillar 16 on a left side of the faceport 14 to the A-pillar 16 on a right side of the A-pillar 16. In other instances, the forwardmost portion 11 of the elongated segmented opening 22 may be forward of the vertical line extending form the A-pillar. In yet other instances, the segmented opening 22 may be positioned as described above, but not connect at a rear of the helmet, or at other portions of the helmet, having the segmented opening being divided into more than one opening, such as two, three, or any other desired number of elongated openings. When two segmented openings 22 are formed, the two segmented openings 22 may be formed as left and right two segmented openings 22 being located on the upper sides of the helmet 10, the left and right segmented openings or vents 22 being separated, e.g., by a piece of the outer shell at the top back of the crown portion of the helmet. As shown, the segmented opening(s) 22 may begin at an area above or vertically offset from a temple area 18 of the helmet 10 where the helmet 10 covers a temple of the user or wearer of the helmet 10.

Thus, as shown in the FIGs., the segmented openings 22 can be formed as a seam that can be defined by the edges of adjacent helmet segments, such as the lower edge 32 of upper portion 30 and the upper edge 42 of the lower portion 40. In some instances, the adjacent edges of the helmet segments (such as edges 32, 42) can be radially offset from each other (in a radial direction from a center C of the helmet (such as at a center of the space to be occupied by a head of the user, or at a center of mass of the helmet) to an outer surface of the helmet 10, such as a point on an outer surface 36 of the upper portion or on an outer surface 46 of the lower portion 40), and comprise an overlap or overlap area O, overlapped (in a direction that is perpendicular or orthogonal to the radial offset r) by a distance in a range of 0-10 millimeters (mm), 3-20 mm, or more. In some instances, when the overlap O is zero (0), or does not overlap, there may still be no radial line of sight or direct line of sight in a radial direction r to the interior 19 or the helmet 10 from points outside of the helmet 10 looking towards the center of the helmet 10. In yet other instances, there may be a small lateral separation (or negative overlap O) between the shell segments, such as upper portion 30 and lower portion 40, to provide a clear line of sight into the interior 19 of the helmet 10, so long as the segmented openings 22 still pass the relevant penetration tests and do not introduce undesirable structural weakness. However, by providing for at least some overlap O of the helmet segments 30, 40, a height H or the separation between helmet segments 30, 40 in the radial direction r can be maintained by one or more reinforcement members or bushings 100 disposed between the upper portion 30 and the lower portion 40 to create the elongated segmented opening 22 in the outer shell 20.

The elongated segmented opening 22 between portions of the segmented outer shell 20 can be larger in some places than in others, such as comprising a range of heights H that varies along the length or distance of the elongated segmented opening 22 along the helmet 10, from a forward most portion 11 of the elongated segmented opening 22 (at a front of the helmet) to a rearward most portion 13 of the elongated segmented opening 22 (at the back of the helmet 10). As shown in FIG. 1, the vent can start at a front of the helmet from a height H of zero, with little or no vertical separation between the adjacent helmet segments (including 1-2 mm of vertical separation), and increase as the vent moves to the back of the helmet where the height H can increase to be in a range of 5-10 mm, 3-15 mm, 0-20 mm, or more. In other instances, the height H of the elongated segmented opening 22 can be constant or vary little (such as 1-10 mm) along a length L of the elongated segmented opening 22, where the length L extends between the forwardmost portion 11 and the rearward most portion 13 of the elongated segmented opening 22. As such, the elongated segmented opening 22 can provide improvements with respect to conventional helmets and vent openings. More specifically, the elongated segmented opening 22 of helmet 10 can comprise an increase in size and area of venting at the outer shell 20, while also providing improved coverage and less exposure (such as to a penetration test) with little or no line of sight from outside the helmet 10 to the interior 19 of the helmet 10 where the user's head will be.

Additionally, rather than providing vents that are merely small openings that go straight into the helmet, extending radially (in the direction r) the center C of the helmet or from the interior 19 to the outer shell 20, the elongated segmented opening 22 in the outer shell 20—defined by the edges 32, 42, of the helmet segments 30, 40, respectively—can connect or open into airflow passages or channels formed in, or through, the energy management material 50 so that air can travel freely through the helmet 10 and adjacent a head of the user. Additionally, the elongated segmented opening 22 allow or enable the helmet 19 to pass a penetration test, in which a spike is dropped onto or into the helmet 10, as prescribed by applicable testing standards, such as those performed by Snell Memorial Foundation, Inc. to meet helmet testing standards such as M2015, EA2016, CMS2007, L-98, and other helmet penetration tests used for the particular helmet type being tested. The helmet 10 can pass the penetration test because little or no separation may be present (and overlap O may be present) between portions of the segmented outer shell 20, such as the upper portion 30 and the lower portion 40, that allow for improved airflow in, out, and through the helmet 10. As such, the helmet 10 improves upon conventional designs in which small (and short) vent openings (such as with a width of 1 cm and a length of less than 2-3 cm) are exclusively used to prevent the penetration test spike from entering the helmet and causing the helmet to fail the penetration test. To the contrary, and as shown in FIG. 1, the current helmet 10 can provide improved ventilation without providing a direct line of sight to the interior 19 of the helmet 10 or to the head of the helmet wearer so that the helmet 10 passes impact test and penetration test standards. The improved ventilation provided by helmet 10 can increase airflow to a point that the user will actually feel cool or cold on his head rather than just feeling less heat, which can be important for users. For example, users, such as motocross riders, can race in extreme heat, and are even at times at risk of heat exhaustion, which can and does at times cause death. As such, the improved ventilation of helmet 10 addresses a long-felt need for both energy management, and improved ventilation, both of which are achieved with helmet 10.

With regards to improved energy management, forming the segmented outer shell 20 as a plurality of segmented shells, such as upper portion 20 and lower portion 40, can provide a number of benefits. First, the inclusion or use of more than one shell segments allows for impacts to transfer more energy from the segmented outer shell 20 to the underlying energy management liner 50 than would otherwise occur with a conventional single or unitary un-segmented outer shell, thereby increasing the length of time of an impact and the average energy of the impact over time. To the contrary, conventional un-segmented shells tend to distribute impact energy throughout the outer shell for a smaller amount of time, preventing longer impacts and lower average energy levels in which more time is used to transfer energy from the outer shell to the energy management liner. With the segmented shell 20, an increased depth of the energy management liner 50 absorbing energy through deformation, over time, is increased due to increased elastic deformation of the segmented outer shell 20, thereby reducing the energy that is transferred to a center of a test dummy head where force of impact is measured, and by extension reducing an amount of energy transferred to a head of a user. By concentrating or absorbing more energy into the energy management layer 50, at a greater depth and for a longer time, which can comprise EPS or other crushable or deformable material, more of the energy management layer can be crushed leaving less energy to reach and possibly harm the user, all other things being equal. Additionally, size, location, and coupling of segments of the segmented outer shell 20 can also influence deformation of the outer shell during impact, thus influencing energy management (including location and distribution) of energy through the helmet 10 and to the user. Thus, the segmented design or configuration of the segmented outer shell 20 can improve energy management during impacts, such as in high-energy impacts.

In some instances, the segments of the segmented outer shell 20, such as the upper portion 30 and the lower portion 40, can be coupled or connected, so as to maintain the elongated segmented openings 22 by including a number of reinforcement members 100 between the adjacent shells. In some embodiments, the reinforcement members 100 can break or snap at a pre-determined or desirable level of energy, or under certain impact conditions, to assist in absorbing and managing impact energy. In other instances, the reinforcement members can remain unbroken to ensure stability of the outer shell.

The helmet 10 can further provide improved venting and cooling by using the elongated segmented openings 22 in the segmented shell 20 as exit ports or ventilation exhaust ports in the helmet 10. The overlap O between the segmented shells can become a vent, comprising height H, that facilitates improved flows F for improved cooling, particularly exit flows. Airflow into the helmet can come through vents or openings other than elongated segmented opening 22, such as through the faceport 14, as well as through other opening formed at the front 8 of the helmet 10, such as at, around, or above the faceport 14, as well as at or near the chin guard 15, through cheek pads 17 or at any other desirable location. Between the intake vents and the exhaust vents or elongated segmented opening 22, the airflow can travel in specialized or dedicated airflow channels that extend between the intake vents and the elongated segmented opening 22 that can be formed, or disposed within, the helmet 10, such as within the energy management liner 50 of the helmet 10.

Additionally, a person of ordinary skill in the art will appreciate that any arrangement of elongated segmented openings 22 along other desirous portions of the helmet 10 may also be implemented to improve airflow F through the helmet 10. Relatedly, the segmented multi-part outer shell 20 may comprise more than the upper portion 30 and the lower portion 40 of with elongated segmented opening 22 on either side 7 of the helmet 10, the elongated segmented openings 22 extending along the lower edge 32 of the upper portion 30 and the upper edge 42 of the lower portion 40.

Figure 2A:
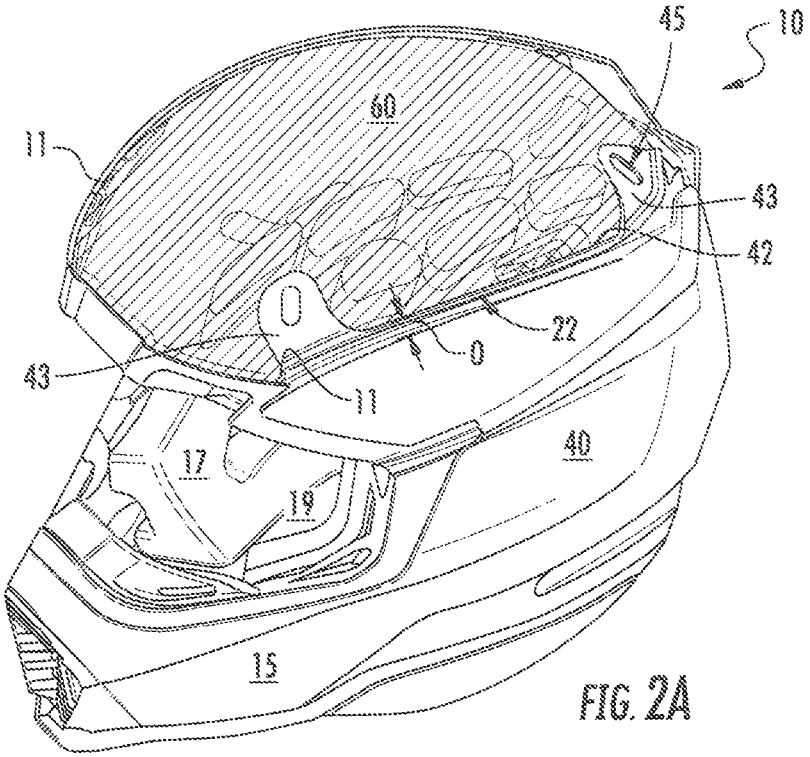
FIG. 2A-2C show various views of s a helmet energy management material.

FIG. 2A shows a perspective view of the helmet 10 with a upper portion 30 of the segmented outer shell 20 being shown as transparent, removed, or cut away, to reveal a portion of the energy management liner 50, and more specifically the outer energy management layer 60. As shown throughout the various FIGs., the energy management liner 50 may comprise multiple energy management layers, such as an outer layer or outer energy management layer 60, and an inner layer or inner energy management layer 80. In some instances the outer energy management layer 60 may be formed of EPS or any other of the energy management materials 50 to manage energy in normal impact scenarios by being crushed or inelastic deformation, and the inner energy management layer 80 may be formed of EPP or or any other of the energy management materials 50 to manage energy in normal impact scenarios by being elastically deformed.

The outer energy management layer 60 can comprise openings 62 that extend completely through the outer energy management layer 60, extending form the inner surface 68 to the outer surface 70. The openings 62 can be smaller or have a footprint or area that is less than the size, footprint, or area of the channels 82 of the inner energy management layer 80. The outer surface 70 can be formed as an uneven surface comprising raised portions standoffs or pillars 64, and recessed portions, grooves, or channels 66, which can encourage and channel airflow F through the helmet in desired ways, such as from the interior 19 out through the elongated segmented openings 22 to increase ventilation and improve cooling for the user.

Figure 2B:
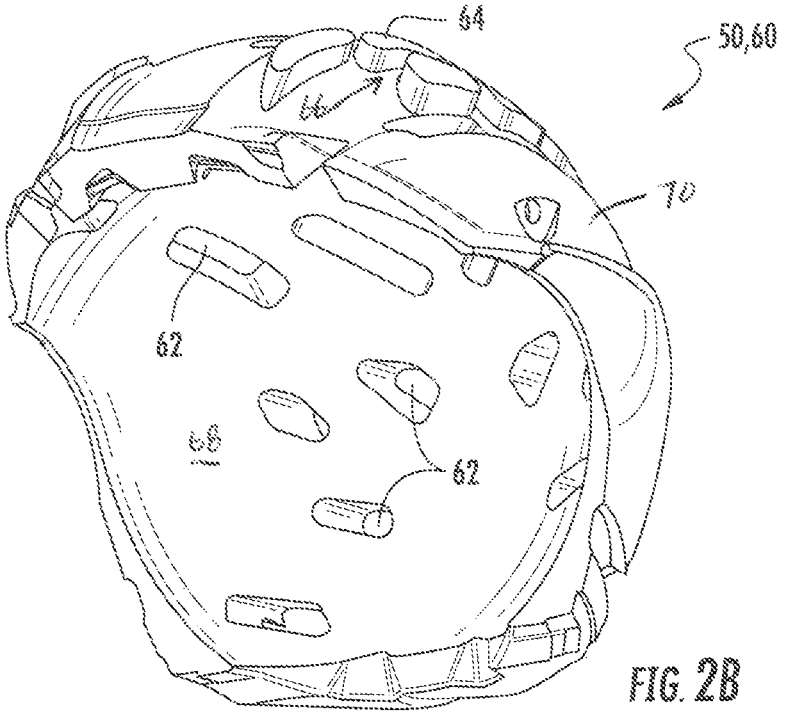
Figure 2C:
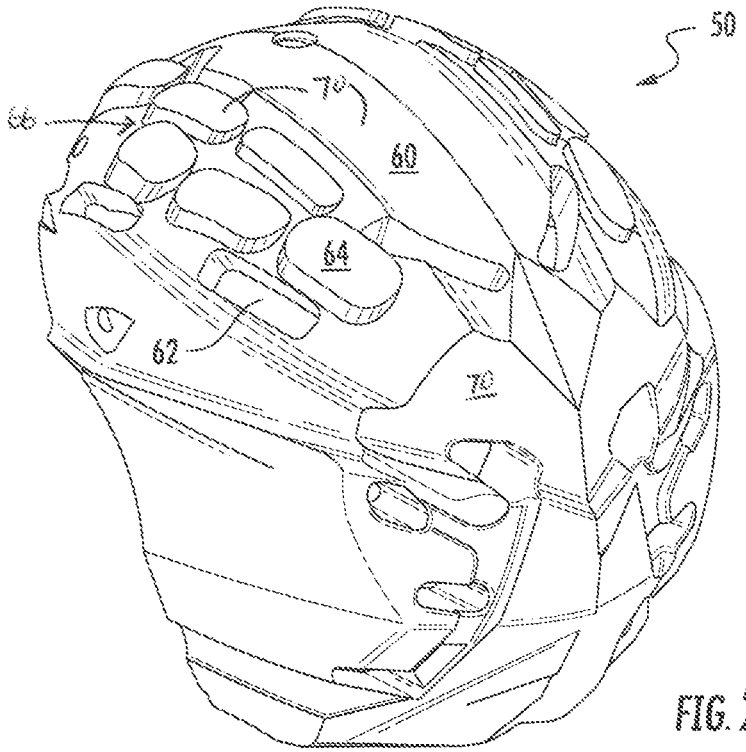

FIGS. 2B and 2C show additional detail of the outer energy management layer 60 from FIG. 2A, but shown in isolation without, and away from, other parts of the helmet 10. FIG. 2B shows a perspective view of the outer energy management layer 60 shown from below and in front of the layer 60, which shows the inner surface 68 can be a surface that is one or more of smooth, round, or spherically shaped, and can additionally include vents, openings, voids, cutouts, or airflow passageways 62 that extend completely through the layer 60. The openings 62 can be of any desirable shape, including elongatedly shaped.

FIG. 2C shows another perspective view of the outer energy management layer 60 similar to that of FIG. 2B, but instead is shown from below and in front of the outer energy management layer 60. FIG. 2C shows additional detail of the uneven, or stepped outer surface 70 of the outer energy management layer 60 that can comprise stand-offs, ridges, pillars, bumps, columns, or protrusions 64 that can directly contact the outer shell 20 in some places, while not extending to touch the outer shell 20 in other places, allowing the airflow F to vent to the elongated segmented openings 22 in the outer shell 20.

Figure 3A:
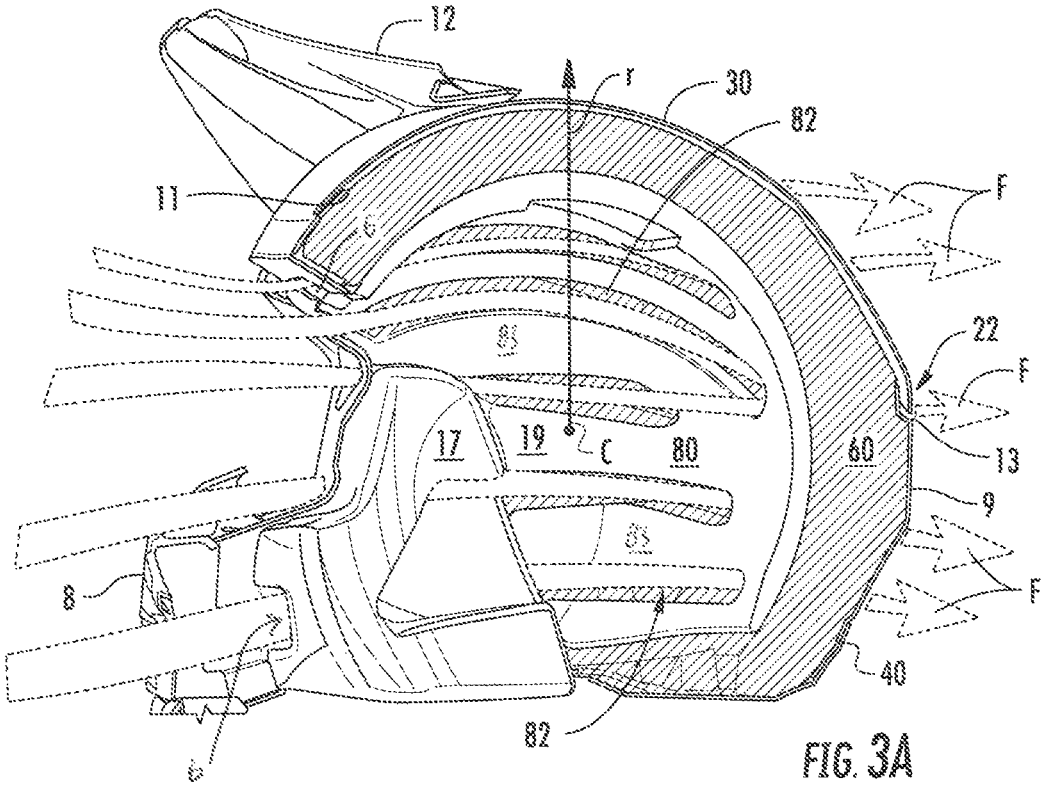
FIGS. 3A-3D show various views of openings in the energy management material and segmented shell for facilitating improved airflow through the helmet.

FIGS. 3A-3D show the outer energy management layer shown in FIGS. 2B and 2C included within a full helmet, and various cut-way views of the helmet. FIG. 3A shows a cross-sectional side view taken along a center, sagittal, or median plane of the helmet 10, with the front 8 of the helmet 10 being shown on the left of the figure and the rear 9 of the helmet 10 being shown on the right of the figure. FIG. 3A also shows the airflow F as a plurality of arrows representing flow paths and airflow through the helmet 10 that enter at the front 8 of the helmet, such as through front air intake vents 6 and through the faceport 14, may travel along the interior of the helmet 19, and may then pass through, or enter directly into, a plurality of airflow channels 82 in the inner energy management layer 80, through openings 62, and out the elongated segmented opening 22 in the outer shell 20. A temperature of the air around and through the helmet 10 can change as the flow F interacts with the user's head and hair and pulls undesired or excess heat away from the head of the user. The portion of the flow F entering at the front 8 of the helmet 10, shown at the left of FIG. 3A, can be cool air that enters and circulates through the helmet, and the flow F at the rear 9 of the helmet 10, or at the right of the helmet 10 can be warmer or hotter air, as the flow F has evacuated, pulled, or transported heat away from the head of the user.

FIG. 3A also shows that the airflow F through the helmet 10 can be aided, assisted, or facilitated by the shape or structure of the energy management layer 50. The inner energy management layer 80 can be inwardly disposed with respect to the outer energy management layer 60, where, for convenience, the FIGs. show the outer energy management layer 60 with cross-hatching. The inner energy management layer 80 can comprise a plurality of elongated channels 82, and a series of fingers or ribs 83 disposed between and defined at least in part by the channels 82. The channels 82 may form a part of the paths of the flow F of air through the helmet 10. Thus, the airflow F need not pass through indirect or circuitous pathways, nor does the airflow F need to pass through a simple hole or opening that extends radially from an outer surface 36, 46 of the helmet 10 to the interior 19 of the helmet 10 (with a line of sight directly to the head of the user. Instead, the airflow F can pass smoothly and directly around a user's head at the interior 19 of the helmet 10 and through the energy management liner 50 and segmented outer shell 20 in smooth provide elongated flows that increase the interface between the airflow F within the helmet 10 and the head of the user for prolonged contact and improved heat transfer. The elongated channels 82 formed within the inner energy management layer 80 may extend from the front 8 to the back 9 of the helmet 10, which differ from conventional power sport helmets, which have comprised openings of small sizes, such as lengths less than 2-3 cm, an circular openings with diameters of 5-10 mm that extend with a clear line of sight, a radial direction, from the outer surface of the helmet to the user's head. The size of the conventional powersports helmet openings has remained small to ensure performance during puncture test, which has limited airflow through the helmet.

Figure 3B:
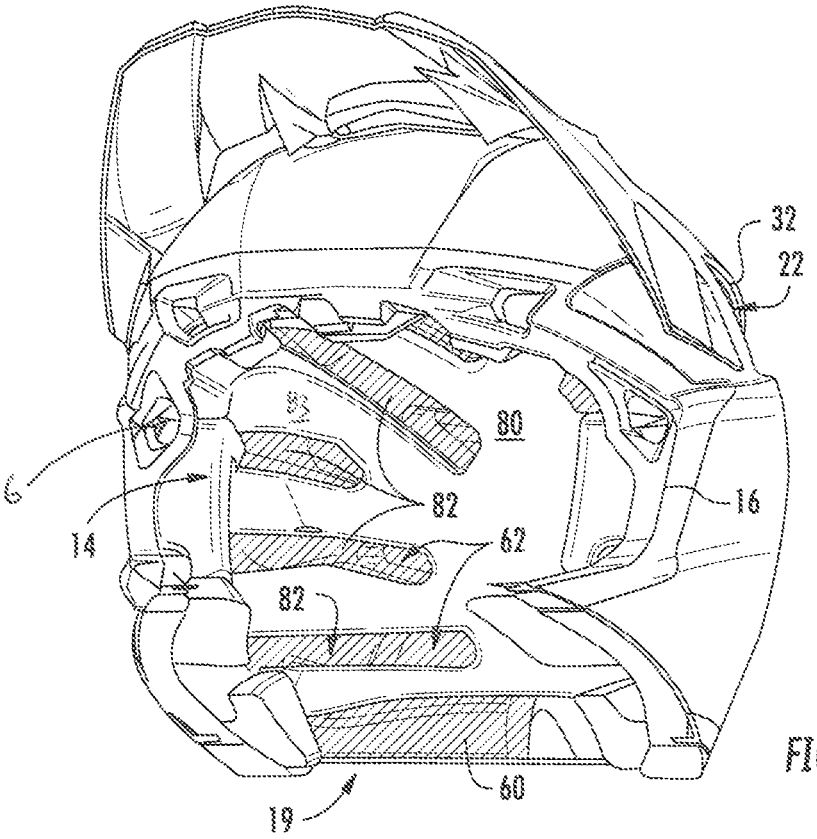

FIG. 3B shows a perspective interior cut-away view of the front and interior of an embodiment of the helmet 10 with the chin guard 15 removed so that the energy management liner 50, including the outer energy management layer 60 and the inner energy management layer 80 inside the segmented outer shell 20 are visible. As shown in FIG. 3B, the inner energy management layer 80 may comprise ribs or fingers 83 and elongated channels 82. At least a portion of the channels 82 may be in contact with, or open to, the head of the helmet wearer so that the airflow F will be in increased contact with the wearer's head, facilitating increased evaporation and cooling. Positions of the front intake vents 6 and the elongated segmented opening 22 shown in the FIGs. have provided desirable results in testing, and good performance. The improved airflow F and elongated segmented opening 22 along the outer shell 22 can provide the same intake and exhaust areas (or larger or slightly larger exhaust areas than intake areas) to provide for good or optimal airflow through the helmet. Improved airflow F can also result from the inner energy management layer 80 being disposed within the outer energy management layer 60, the channel 82 being formed completely through the inner energy management layer 80, the channel 82 further being aligned, and overlapping a distance x of at least 1 cm, with the opening 62 in the outer energy management layer 60. Improved airflow F can further pass through the elongated segmented openings 22. In instances where less airflow is desired, such as in cold environments where a user wishes to retain body heat, the user can place plugs or stoppers made of rubber, plastic, or other suitable material into the intake vents 6, elongated segmented opening 22, or both, to limit the airflow through the airflow channels and reduce cooling and ventilation through the helmet.

Figure 3C:
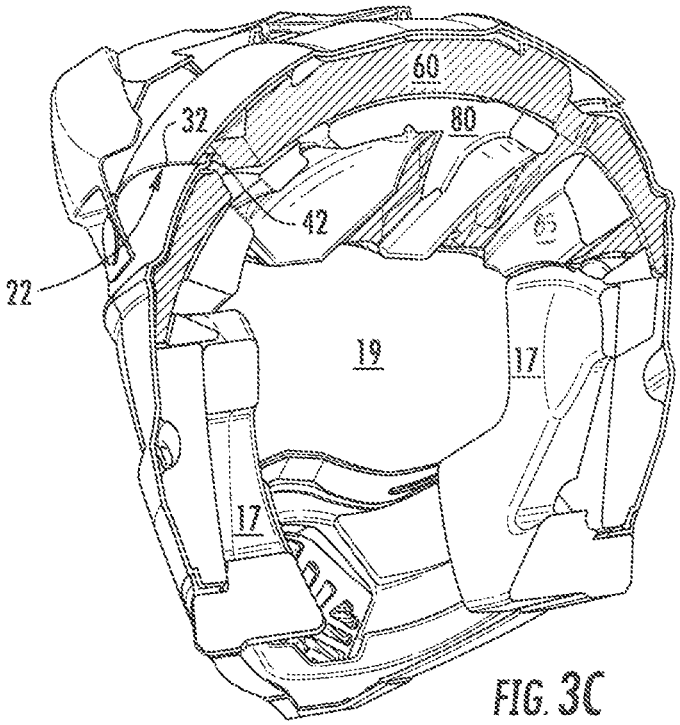

FIG. 3C shows a perspective interior cut-away view from the rear 9 or behind the helmet to show a cross-sectional view of the energy management layers 60, 80 inside the helmet 10, and their interaction for facilitating the airflow F through the helmet 10 to the elongated segmented opening 22 in the outer shell 20. When comfort padding is placed inside the helmet, the comfort padding can be placed along the fingers or ribs 83 of the inner energy management layer 80 so that the airflow F is not blocked or impeded by the comfort padding. Applicant have discovered that even mesh or fabrics and textiles with openings as part of the comfort padding that extends over the channels 82 can significantly diminish airflow and cooling.

Figure 3D:
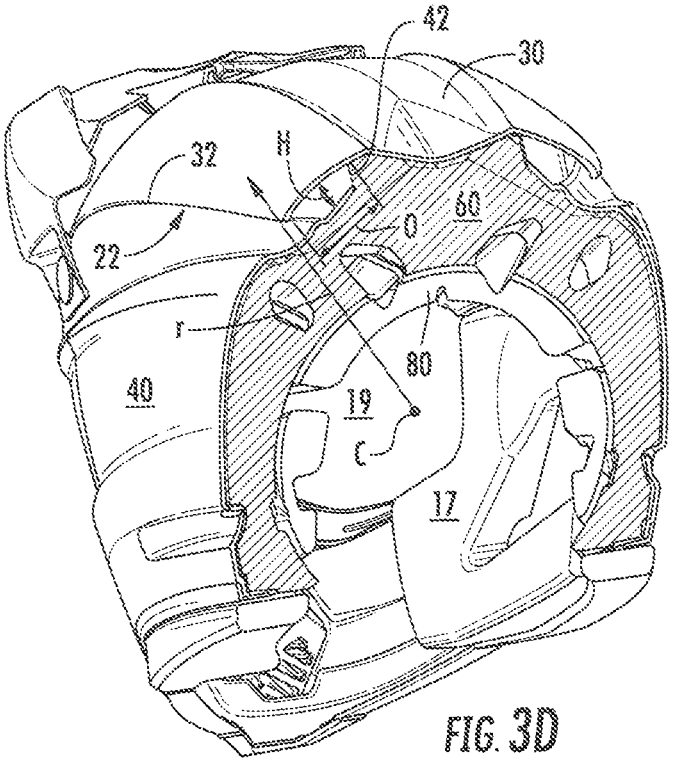

FIG. 3D, similar to FIG. 3C, shows another perspective cut-away view from the rear 9 or from behind the helmet 10 so that the energy management liner 50 inside the helmet, and the pathways for the airflow F through the helmet to the elongated segmented opening 22 in the outer shell 20 are visible.

Figure 4A:
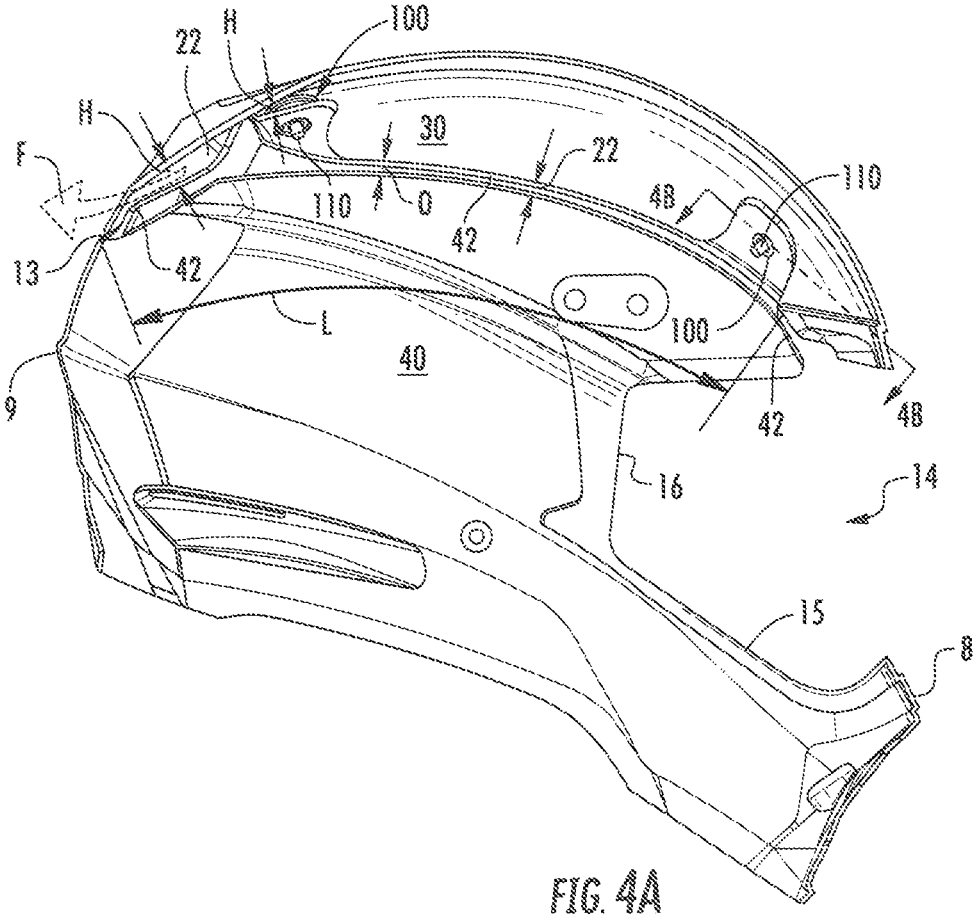
FIGS. 4A-4F show various views of the segmented shells and bushings for coupling the helmet segments together.

FIG. 4A, shows a cross-sectional side view of the entire segmented outer shell 20 of the helmet 10 comprising the upper portion 30 coupled to the lower portion 40 of the outer shell 20. A reinforcement member 100 can be disposed between the upper portion 30 and the lower portion 40 of the shell 20. In some instances, the reinforcement members 100 may be formed as bushings or sleeves comprising a flattened top portion 102 and a smaller stem portion 104, together forming a mushroom type shape. The reinforcement members 100 may be formed as bushings with a generally circular or tubular shape and may further comprise an opening or channel 106, which can also be circular, passing through an axis or a center of the reinforcement member 100, including booth the top portion 102 and the stem portion 104. The opening 106 can be for receiving a pin, rod, spindle, pinion, post, pillar, or stud 110, to couple the reinforcement member 100 between segments of the segmented outer shell 20, such as segments 30, 40 of the helmet 10.

In some instances, the reinforcement members 100 may not be formed as bushings per se, but may be formed as vertical offset members, such as with an opening 106 for receiving pins 110 or other similar structures that are coupled, or directly attached, to an inner surface 34 of the upper portion 30 of the segmented outer shell 20, or an inner surface 44 of the lower portion 40 of the segmented outer shell 20. In some instances, the reinforcement members 100 can be formed of a same material and at a same time of as the segmented outer shell 20. As such, the outer shell 20 can, in some instances, still be formed as unitary outer shell, although with a non-uniformly planar surface, and elongated segmented openings 22. In yet other instances, the reinforcement members 100 may be formed of a material that is different than, the material of the outer shell 20, such as a softer more deformable material, including rubber, phenolic, plastic, fiberglass, or other suitable material capable to handle manufacturing tolerances, provide flexible support and a buffer for the outer shell 20.

Figure 4B:
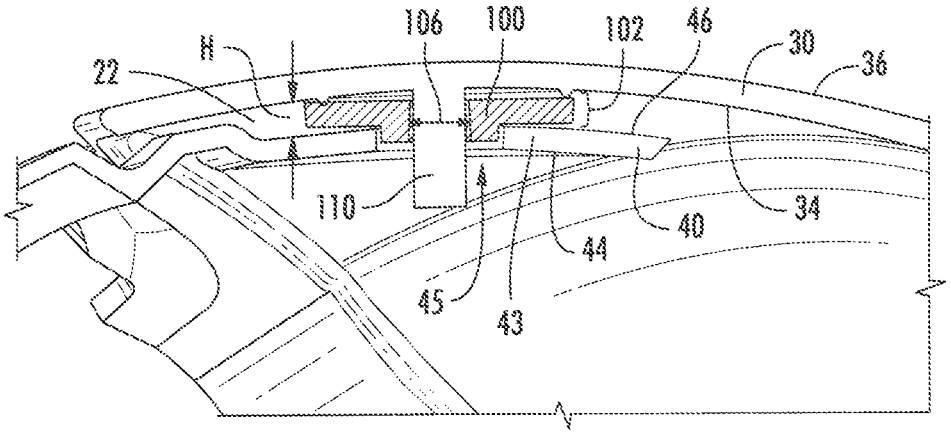

FIG. 4B, shows a cross-sectional view transverse or perpendicular to the cross-section view shown in FIG. 4A. FIB. 4B shows some of the upper portion 30 and some of the lower portion 40 of the segmented outer shell 20 with a reinforcement member 100 disposed between the upper portion 30 and the lower portion 40. In some instances, the reinforcement members 100 may be formed with a mushroom shape comprising a flattened top portion 102 and a lower stem portion 104, wherein the top portion 102 comprises an area or footprint larger than an area or footprint of the lower stem portion 104. The central opening 106 may extend through the flattened portion 102 and the stem portion 104, and be sized to receive a pin, rod, spindle, pinion, post, pillar, or stud 110. The pin 110 may be formed of a unitary construction with either the upper portion 30 of the segmented outer shell 20 or the lower portion 40 of the segmented outer shell 20. As such, the pin 110 may be integrally formed or molded as a single, unitary, or mono-formed piece and at a same time or in a same process as the formation or molding of the shell 20, or a portion of the shell 20, such as the upper portion 30 or the lower portion 40 of the segmented outer shell 20. In other instances, the pin 110 may be formed separately from, and be later joined with, a portion of the helmet 10, such as with either the upper portion 30 or the lower portion 40 of the segmented outer shell 20, so that the pin 110 is not of a unitary construction or mono-formed.

Figure 4C:
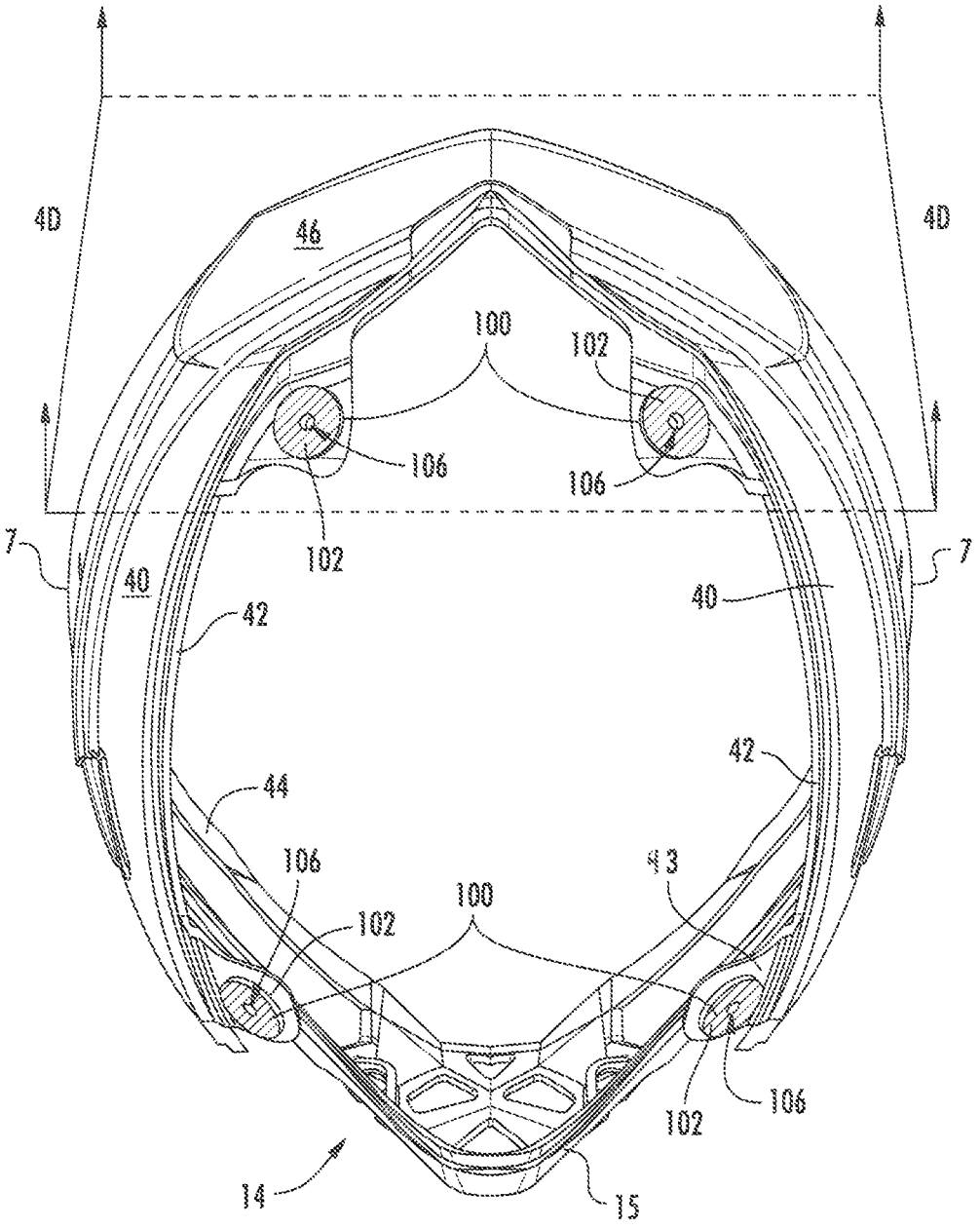

FIG. 4C, shows a top-down perspective view of the lower portion 40 of the segmented outer shell 20 with four reinforcement members 100 disposed on four corresponding tabs or flanges 43 of the lower portion 40. While four tabs 43 are shown, two at a front 8 of the helmet 10 and two at the rear 9 of the helmet, any desirable number of tabs 43 and corresponding reinforcement members 100 may be used. However, the number and location of tabs 43 and corresponding reinforcement members 100 shown have been found desirable. The tabs 43 may comprise openings 45 that can align with opening 106 in reinforcement members 100 which together can receive pin 110 or other suitable locking or securing member for coupling segments 30, 40 of the segmented outer shell 20 to each other.

Figure 4D:
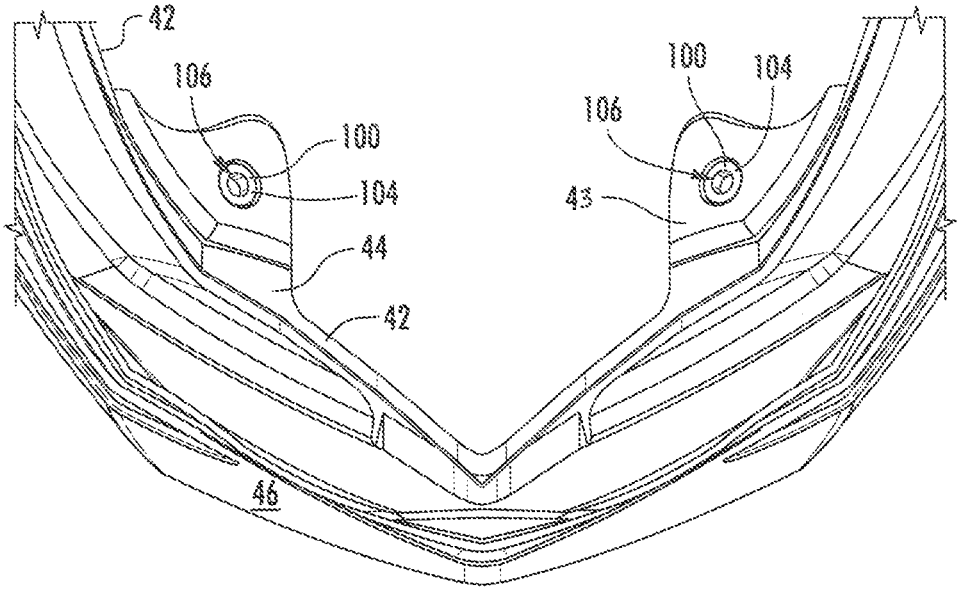

FIG. 4D, shows a bottom-up view of a rear piece of the lower portion 40 of the shell 20 taken along the section line 4D-4D shown in in FIG. 4C. FIG. 4D also shows two rear reinforcement members 100 for coupling the upper portion of the segmented outer shell 30 to the lower portion 40 of the segmented outer shell 20.

Figure 4E:
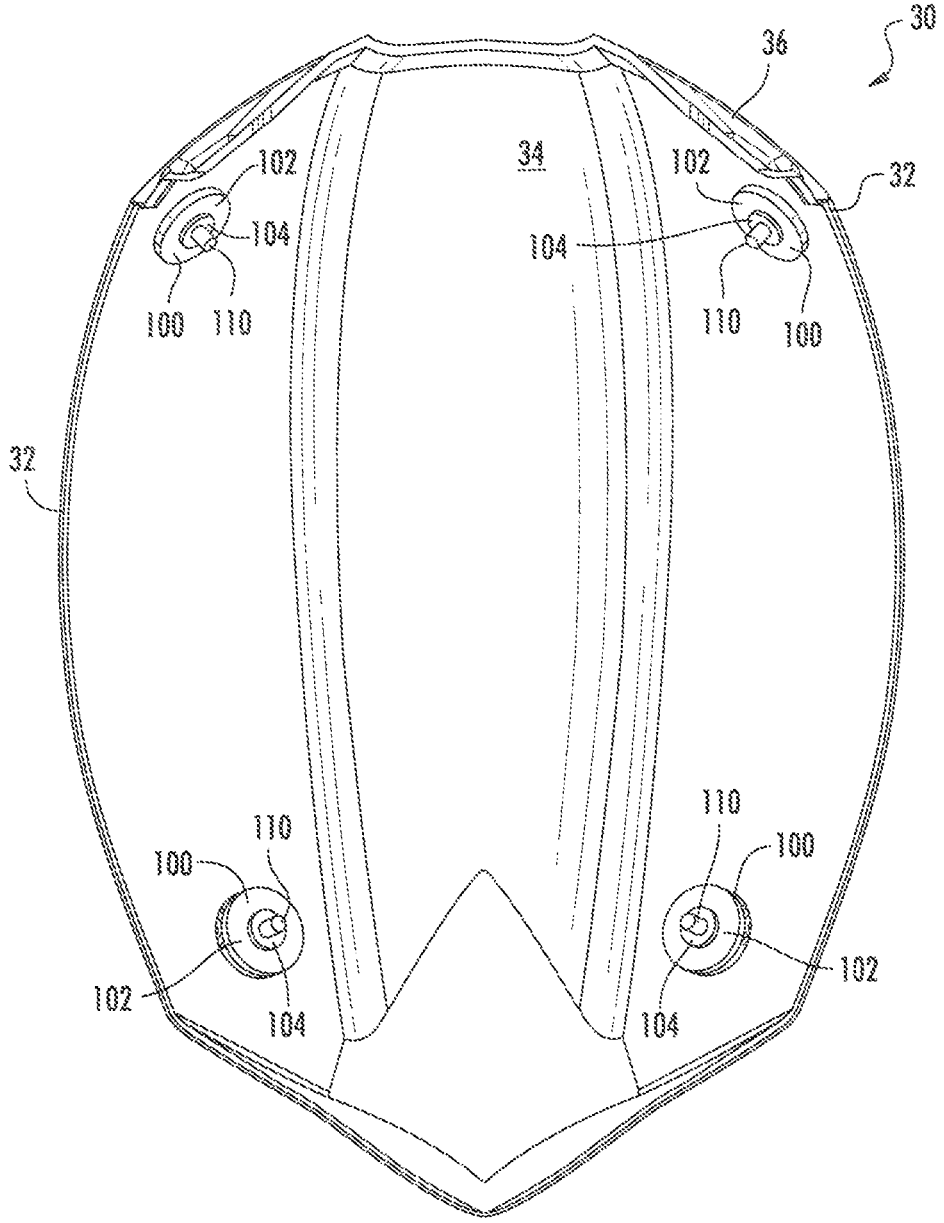

FIG. 4E, shows a bottom view of the upper portion of the segmented outer shell 30 with four reinforcement members 100 coupled to pins 110, corresponding to, and being configured to be mateably coupled with, the lower portion of the segmented lower shell 40 shown in in FIG. 4C. While both FIGS. 4C and 4E have shown, for reference, the positions of the reinforcement members 100 with respect to the segmented outer shell 20, when the upper portion 30 is coupled to the lower portion 40, only one reinforcement member 100 per position may be used. However, in other instances, multiple reinforcement member 100 of varying shape, design, material, strength, and elasticity, may be used in conjunction with one another, such as by being stacked or interconnected.

Figure 4F:
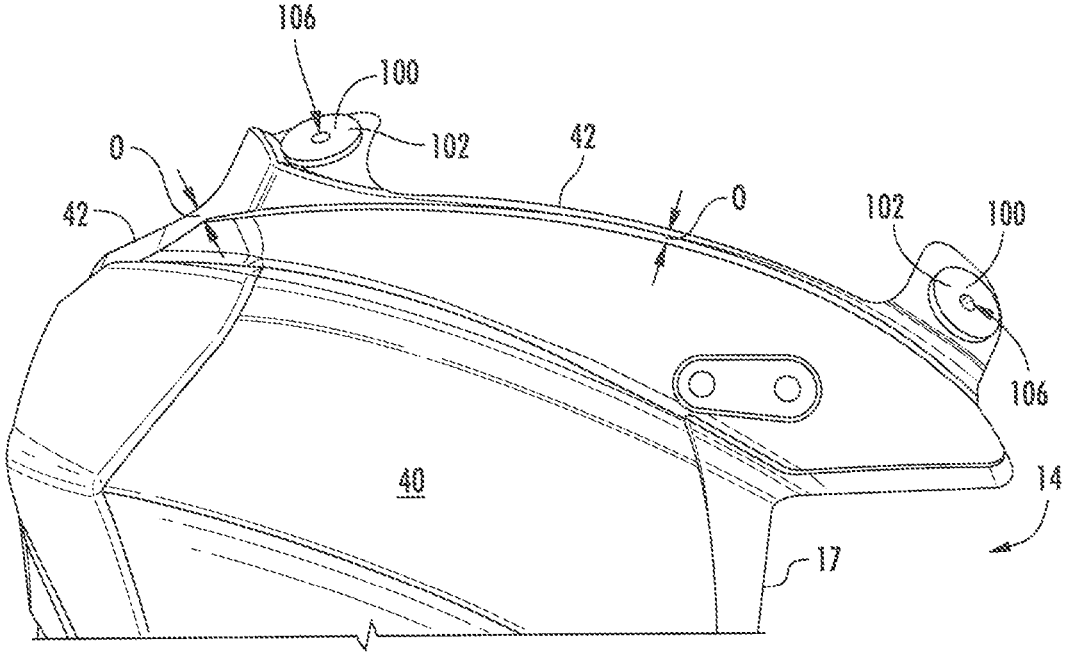

FIG. 4F, shows a side elevational view of a top section of the side 7 of the lower portion 40 of the segmented lower shell 20. FIG. 4F also shows front and rear reinforcement members 100 disposed on tabs 43.

It will be understood that implementations of the foregoing are not limited to the specific components disclosed herein, as virtually any components consistent with the intended operation of a method or system implementation for helmets may be utilized. Accordingly, for example, although particular helmets may be disclosed, such components may comprise any shape, size, style, type, model, version, class, grade, measurement, concentration, material, weight, quantity, and/or the like consistent with the intended operation of a method or system implementation for a helmet may be used. In places where the description above refers to particular implementations of helmets, it should be readily apparent by those of ordinary skill in the art that other helmet and manufacturing devices and examples could be intermixed or substituted with those provided, and that a number of modifications may be made without departing from the spirit thereof and that these implementations may be applied to other helmets. Therefore, the disclosed subject matter is intended to embrace all such alterations, modifications and variations that fall within the spirit and scope of the disclosure and the knowledge of one of ordinary skill in the art.

What is claimed is:

1. A helmet comprising:
- a segmented outer shell comprising:
  - an upper portion,
  - a lower portion, and
  - a reinforcement member disposed between the upper portion and the lower portion to create an elongated segmented opening in the outer shell;
- an energy management liner disposed within the segmented outer shell and further comprising:
  - an outer energy management layer comprising an opening formed completely through the outer energy management layer, and
  - an inner energy management layer disposed within the outer energy management layer, the inner energy management layer comprising a channel formed completely through the inner energy management layer that is aligned, and overlaps at least 1 centimeter (cm), with the opening in the outer energy management layer and facilitates airflow through the elongated segmented opening.

2. The helmet of claim 1, wherein the elongated segmented opening comprises a length greater than 3 cm and a height in a range of 0.2-1.5 cm.

3. The helmet of claim 1, wherein:
- the upper portion of the segmented outer shell covers a top and a crown of the helmet;
- the lower portion of the segmented outer shell covers a side of the helmet and a rear of the helmet; and
- the elongated segmented opening extends along an interface of the upper portion of the segmented outer shell and the lower portion of the segmented outer shell from an a-pillar of the faceport toward the rear of the helmet.

4. The helmet of claim 1, wherein the reinforcement member is formed as a bushing coupled to a pin formed of a unitary construction with either the upper portion of the segmented outer shell or the lower portion of the segmented outer shell.

5. The helmet of claim 1, wherein the reinforcement member is formed as a bushing made of a material softer than the outer shell.

6. The helmet of claim 1, wherein the elongated segmented opening comprises a length in a range of 3-20 cm.

7. The helmet of claim 1, wherein:
- the outer energy management layer is formed of expanded polystyrene (EPS); and
- the inner energy management layer is formed of expanded polypropylene (EPP).

8. A helmet comprising:
- a segmented outer shell comprising an elongated segmented opening;
- an energy management liner disposed within the segmented outer shell and further comprising:
  - an outer energy management layer comprising openings formed completely through the outer energy management layer, and
  - an inner energy management layer disposed within the outer energy management layer, the inner energy management layer comprising channels formed completely through the inner energy management layer that are aligned, and overlap by at least 1 centimeter (cm), with the openings in the outer energy management layer and facilitate airflow through the elongated segmented opening.

9. The helmet of claim 8, wherein the elongated segmented opening comprises a length greater than 3 cm and a height greater than 0.2 cm.

10. The helmet of claim 9, wherein:
- the upper portion of the segmented outer shell covers a top and a crown of the helmet;
- the lower portion of the segmented outer shell covers a side of the helmet and a rear of the helmet; and
- the elongated segmented opening extends along an interface of the upper portion of the segmented outer shell and the lower portion of the segmented outer shell from an a-pillar of the faceport to the rear of the helmet.

11. The helmet of claim 8, wherein the segmented outer shell further comprises:
- a first portion;
- a second portion; and
- a reinforcement member disposed between the first portion and the second portion to create the elongated segmented opening in the outer shell.

12. The helmet of claim 11, wherein the reinforcement member is formed as a bushing made of a material softer than the outer shell.

13. The helmet of claim 11, wherein the reinforcement member is coupled to pins formed of unitary construction with either the first portion of the segmented outer shell or the second portion of the segmented outer shell.

14. The helmet of claim 11, wherein the elongated segmented opening comprises a length in a range of 1-20 cm.

15. A helmet comprising:

a segmented outer shell comprising:

an upper portion, a lower portion, and a reinforcement member disposed between the upper portion and the lower portion to create an elongated segmented opening in the outer shell; and an energy management liner disposed within the segmented outer shell and further comprising a channel formed completely through the inner energy management layer that is aligned, and overlaps at least 1 centimeter (cm), with the opening in the outer energy management layer and facilitate airflow through the elongated segmented opening.

16. The helmet of claim 15, wherein the elongated segmented opening comprises a length greater than 3 cm and a height greater than 0.2 cm.

17. The helmet of claim 15, wherein:

the upper portion of the segmented outer shell covers a top and a crown of the helmet;

the lower portion of the segmented outer shell covers a side of the helmet and a rear of the helmet; and the elongated segmented opening extends along an interface of the upper portion of the segmented outer shell and the lower portion of the segmented outer shell from an a-pillar of the faceport to the rear of the helmet.

18. The helmet of claim 15, wherein the energy management liner further comprises:

an outer energy management layer comprising an opening formed completely through the outer energy management layer; and an inner energy management layer disposed within the outer energy management layer, the inner energy management layer comprising the channel that overlaps with the opening in the outer energy management layer and the elongated segmented opening.

19. The helmet of claim 15, wherein the reinforcement member is formed as a bushing made of a material softer than the outer shell.

20. The helmet of claim 15, wherein the reinforcement member is formed as a bushing coupled to a pin formed of unitary construction with either the upper portion or the lower portion.

* * * * *